US008327472B2

(12) United States Patent
Inglin et al.

(10) Patent No.: US 8,327,472 B2
(45) Date of Patent: Dec. 11, 2012

(54) FLUSHING ARRANGEMENT FOR A WC AND METHOD OF OPERATING SUCH A FLUSHING ARRANGEMENT

(75) Inventors: Urs Inglin, Lachen (CH); Abdullah Oengören, Sirnach (CH); Peter Schwendener, Samstagern (CH)

(73) Assignee: Gerberit International AG, Jona (CH)

( * ) Notice: Subject to any disclaimer, the term of this patent is extended or adjusted under 35 U.S.C. 154(b) by 188 days.

(21) Appl. No.: 12/836,354

(22) Filed: Jul. 14, 2010

(65) Prior Publication Data

US 2011/0016623 A1 Jan. 27, 2011

(30) Foreign Application Priority Data

Jul. 24, 2009 (EP) ..... 09405125

(51) Int. Cl.
*E03D 11/02* (2006.01)

(52) U.S. Cl. ..... 4/421

(58) Field of Classification Search ..... 4/421, 420; 73/170.01; 116/273
See application file for complete search history.

(56) References Cited

U.S. PATENT DOCUMENTS

| | | | | |
|---|---|---|---|---|
| 287,225 | A | 10/1883 | Buchan | |
| 3,984,878 | A | 10/1976 | Grasseschi | |
| 4,987,616 | A * | 1/1991 | Ament | 4/421 |
| 2008/0060122 | A1 | 3/2008 | Andreiu | |

FOREIGN PATENT DOCUMENTS

| | | | |
|---|---|---|---|
| EP | 1034338 | B1 | 9/2000 |
| EP | 1034338 | * | 9/2003 |
| WO | 95/04196 | A1 | 2/1995 |

* cited by examiner

*Primary Examiner* — Lori Baker
(74) *Attorney, Agent, or Firm* — Sughrue Mion, PLLC

(57) ABSTRACT

The flushing arrangement has a toilet bowl (2) which has an inlet (3) and an outlet (21) and, between these, means (8, 20) for generating a pulse. By means of the pulse, water (13) which is present in a U-bend (4) and forms a stench trap can be accelerated, for a flushing operation, in the direction of the outlet (21). Said means (8, 20) are arranged in the descending region of the toilet bowl (2) and, during flushing, generate a downwardly directed flow cone (14, 14'). The flow narrows downwardly and at a saddle point (26) forms a wall jet (28) which cleans the U-bend (4) particularly thoroughly.

14 Claims, 2 Drawing Sheets

Figure 1:
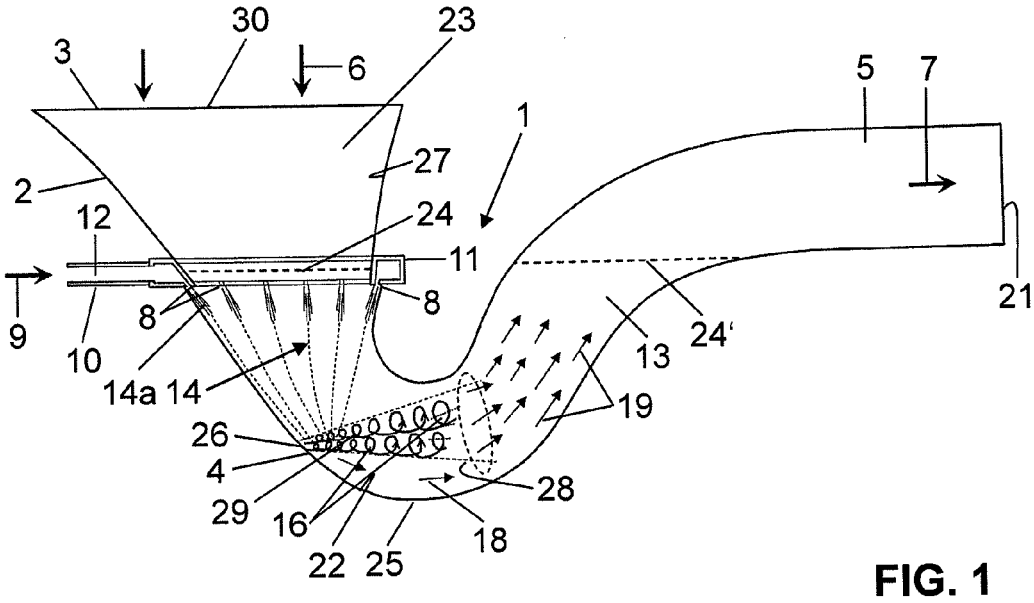

FLUSHING ARRANGEMENT FOR A WC AND METHOD OF OPERATING SUCH A FLUSHING ARRANGEMENT

The invention relates to a flushing arrangement for a WC, having a toilet bowl which has an inlet and an outlet and, between these, means for generating a pulse by means of which water which is present in a U-bend and forms a stench trap can be accelerated, for a flushing operation, in the direction of the outlet.

The consumption of flushing water can be significantly reduced in a WC if, according to the applicant's WO 95/04196, during flushing the water present in the U-bend is set in motion by a so-called jet nozzle. The water which the nozzle discharges into the U-bend at comparatively high speed can accelerate the water in the U-bend towards the outlet, and so the U-bend is flushed out to better effect. A disadvantage here is that the water which flows into the U-bend gives rise to additional noise and in addition the action of the jet nozzle can be at least greatly reduced by solid matter in the U-bend.

EP-A-103 43 38 discloses a WC which likewise has a jet nozzle. The nozzle introduces a mixture of water and air. Arranged at the front end of the nozzle is a negative-pressure chamber which is intended to ensure that the water-air mixture is channelled in the direction of the axis of the inlet of the U-bend, as is mentioned in [0027]. The introduction of said mixture likewise appears to give rise to additional noise.

Tests have shown that, when solids are present in the U-bend, the accelerating action of the jet nozzle is greatly reduced.

It is an object of the invention to provide a flushing arrangement of the aforementioned type which avoids the aforementioned disadvantages and additionally allows an even more effective cleaning action.

The object is achieved in the case of a generic flushing arrangement in that the means are arranged in the descending region of the toilet bowl and, during flushing, generate a downwardly directed flow cone. The descending region of the U-bend can be cleaned particularly effectively by such a flow cone. This region is generally more heavily soiled than the region of the toilet bowl above it. This generally lightly soiled region can generally be cleaned sufficiently by the main flushing generated at the rim of the toilet bowl. The contents of the U-bend can be ejected by the flow cone and additionally the aforementioned region can be cleaned more effectively than hitherto. This flow moves downwards at a comparatively high speed.

The flow can be concentrated by the convex shape of the bowl and can finally strike the inside of the toilet bowl at a saddle point in the lower region of the toilet bowl and be reflected there. This forms a very compact wall jet, which greatly accelerates the water in the lower region of the U-bend towards the outlet. This lower region of the U-bend is generally the most heavily soiled region. The wall jet has a very high pulse density and as a result generates strong local dynamic forces on the inside of the U-bend, on the water in the U-bend and on solid matter located in the lower region of the U-bend. Both the water in the U-bend and the solid matter are pushed particularly effectively towards the outlet by this wall jet. This procedure continues until all the contents of the toilet bowl have been flushed out. Owing to the high pulse density, solid residues remaining on the inside of the toilet bowl are detached more thoroughly than hitherto. The flushing arrangement according to the invention thus allows even more thorough flushing and thus even better hygiene. In addition, it has been shown that noise is substantially reduced.

According to one development of the invention, it is provided that the means are arranged in the region of the U-bend water line of the toilet bowl. As a result, a particularly effective wall jet can be formed. Due to the downwardly directed flow, the inside of the toilet bowl below the U-bend water line is cleaned. The means are preferably arranged directly above or below the U-bend water line.

According to one development of the invention, it is provided that the means have a plurality of pulse nozzles or at least one annular gap. The plurality of pulse nozzles are arranged in an annular manner and give rise to the conical downwardly directed flow. These pulse nozzles can be designed identically. It is, however, also conceivable for these pulse nozzles to be designed differently. As an alternative to a plurality of pulse nozzles, it is possible for the aforementioned means to have an annular gap. The water flows downwardly through this annular gap and likewise gives rise to a conical flow. The annular gap may extend all the way round the inside of the toilet bowl or of the U-bend. However, a design having a plurality of such annular gaps is also conceivable. The pulse nozzles may be arranged individually on the toilet bowl, but alternatively may be connected together via an annular channel. This annular channel may extend partially or completely around the periphery of the toilet bowl. A combination of pulse nozzles and at least one annular gap is also conceivable.

The pulse can be generated by water, air or a water-air mixture.

According to one development of the invention, it is provided that the inside of the descending region of the U-bend narrows downwardly and that medium flowing out of the means during flushing flows downwardly along this inside to a saddle point arranged in a lower region of the U-bend. The saddle point is preferably located upstream of the deepest point of the U-bend, as seen in the direction of flow. The wall jet forming at the saddle point is preferably directed such that it extends horizontally into the U-bend. Preferably, the wall jet consists of one or more rotating vortices and a core jet. This leads to particularly thorough cleaning and flushing out of the U-bend.

The invention additionally relates to a method of operating such a flushing arrangement. Preferably, in addition to the aforementioned flushing via the aforementioned means, a main flushing is initiated, in which flushing water flows out of a conventional flushing channel into the toilet bowl. This main flushing can take place substantially at the same time as the flushing at the aforementioned means. However, serial flushing is also conceivable. The main flushing can thus also take place before or after the flushing with the aforementioned means.

Further advantageous features are given in the dependent patent claims, the following description and the drawing.

Figure 2:
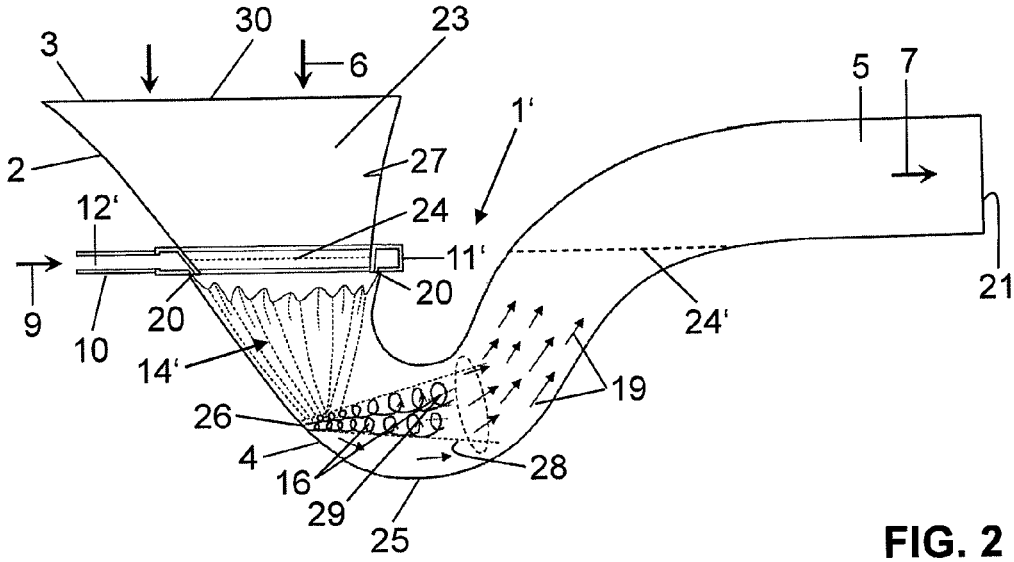
Figure 3:
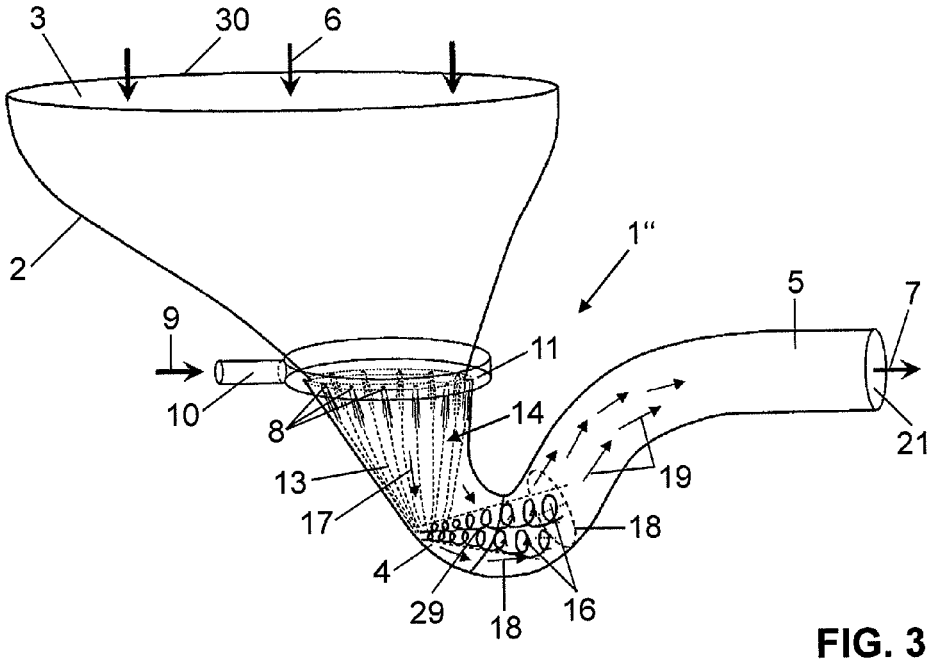

Exemplary embodiments of the invention are explained in more detail hereinbelow with reference to the drawing, in which:

FIG. 1 schematically shows a section through a flushing arrangement according to the invention, FIG. 2 schematically shows a section through a variant of the flushing arrangement according to the invention, and FIG. 3 schematically shows a three-dimensional view of a further variant of the flushing arrangement according to the invention.

The flushing arrangement 1 shown in FIG. 1 has a toilet bowl 2 which has an inlet 3 and an outlet 21. In the region of the inlet 3 there is a flushing channel (not shown here) which is known per se and out of which water flows, during a main flushing, in the direction of the arrows 6 downwardly along an inside 27 into a U-bend 4.

The water 13 located in the U-bend 4 is ejected from the U-bend 4 and leaves the toilet bowl 2 at the outlet and passes from there into a downpipe (not shown here). The toilet bowl 2 thus has a descending region which extends as far as a vertex 25 of the U-bend 4. The ascending region then begins. The water 13 forms in the descending region a U-bend water line 24 and in the ascending region a U-bend water line 24'. Both U-bend water lines 24 and 24' are of course in the same horizontal plane. The water of the main flushing originates for example from a cistern (not shown here) or directly from a water main.

Means for generating a pulse are provided in the region of the U-bend water line 24 in the descending region of the toilet bowl 2. According to FIG. 1, these means comprise a plurality of pulse nozzles 8, which form a flow cone 14 along the inside 27 of the toilet bowl 2. This flow cone 14 has a cleaning action on the inside of the toilet bowl 2 in the descending region. These pulse nozzles 8 are arranged on a distributor ring 11 which has an annular design and forms a likewise annular channel 12. The openings in the pulse nozzles 8 are arranged on the inside 27 of the toilet bowl 2 and, in the case of a flushing, form in each case a jet 14*a* which is directed downwardly and has a comparatively high speed. The distributor ring 11 has an inlet pipe 10 through which water can be introduced into the channel 12 in the direction of the arrow 9. The water is introduced here under pressure. Instead of water, however, air or an air-water mixture can also be introduced into the channel 12. Air or an air-water mixture thus flows out of the pulse nozzles 8 and into the toilet bowl 2. The water 13 is accelerated towards the outlet 21 by the jets 14*a*. Owing to the conical or convex inside 27, the jets 14*a* of the pulse nozzles 8 converge in the form of the flow cone 14. The jets 14*a* or the flow cone are/is focused on the saddle point 26, which is located in the lower region on the inside 27 of the U-bend 4. The saddle point 26, which is of course not a point in the geometric sense, is formed by a lower region of the inside 22 of the U-bend 4. A reflection of the flow cone 14 at the saddle point 26 forms a wall jet 28, which is indicated in FIG. 1 with dashed lines. This wall jet 28 has a very high pulse density and extends substantially horizontally into the U-bend 4. This wall jet 28 accelerates the water in the U-bend 4 in the direction of the arrows 18 initially substantially horizontally and then obliquely upwards in the direction of the arrows 19 in the ascending region of the U-bend 4. As a result, the water 13 is ejected from the U-bend 4 and passes into an outflow pipe 5 to the outlet 21. At the same time, any solid matter present is also ejected with the water 13. The generally heavily soiled inside 22 in the region of the U-bend 4 is very effectively flushed here and thus cleaned of solid matter. The emptied U-bend 4 is refilled with water from the main flushing. The pulse occurs for a comparatively short time of for example two to three seconds.

The wall jet 28 can, according to FIG. 1, have rotating vortices 16, which intensify the flushing out and cleaning of the inside of the U-bend 4 (which when filled with water acts as a "stench trap."). In particular, two symmetrical vortices 16 were established. In addition, the wall jet 28 can have a core jet 29 (not shown in more detail) directed towards the outlet 21. This core jet 29 likewise brings about the ejection of the water 13, as is illustrated by the arrows 18 and 19.

The flushing arrangement 1' shown in FIG. 2 differs from that according to FIG. 1 in that, instead of the plurality of pulse nozzles 8, there is an annular gap 20, out of which the water flows downwardly in the form of a flow cone 14'. The annular gap 20 is likewise of a substantially annular design and, as can be seen, is directed downwardly along the inside 27. In this case, too, the medium flowing in can be water, air or an air-water mixture. The supply of the medium likewise takes place here via a channel 12'. Instead of a single peripheral annular gap 20, it is possible for a plurality of annular gaps to be present. A combination of individual pulse nozzles 8 and an annular gap 20 is also conceivable. In addition, an embodiment in which two or more annular gaps 20 of this kind are arranged one above the other is conceivable. This is likewise conceivable in the embodiment according to FIG. 1, in which case a plurality of flow cones 14 would be arranged in an annular manner one above the other. In a corresponding manner, two or more channels 12 or 12' can then be provided.

The flushing arrangement 1" according to FIG. 3 corresponds substantially to that according to FIG. 1. However, the pulse nozzles 8 are arranged here above the U-bend water line 24. The flow cones 14 are thus formed above the U-bend water line 24 along the inside 27 and then pass at the level of the U-bend water line 24 into the water 13 of the U-bend 4. A corresponding arrangement is possible in the flushing arrangement 1' according to FIG. 2. The pulse nozzles 8 and the annular gap 20 can also be arranged below the U-bend water line 24 in the descending region of the U-bend 4. They are, however, preferably arranged substantially upstream of the vertex 25.

LIST OF REFERENCE SIGNS

1 Flushing arrangement
2 Toilet bowl
3 Inlet
4 U-bend
5 Outflow pipe
6 Arrow
7 Arrow
8 Pulse nozzles
9 Arrow
10 Inlet pipe
11 Distributor ring
12 Channel
13 Water
14 Flow cone
14*a* Jet
16 Vortex
17 Arrow
18 Arrow
19 Arrow
20 Annular gap
21 Outlet
22 Inside
23 Inner space
24 U-bend water line
25 Vertex
26 Saddle point
27 Inside
28 Wall jet
29 Core jet
30 Upper flushing channel

The invention claimed is:

1. A flushing arrangement for a water closet, having a toilet bowl-which has an inlet and an outlet and, between said inlet and outlet, means for generating a pulse by means of which water, which is present in a U-bend and provides a stench trap, can be accelerated, for a flushing operation, in the direction of the outlet, wherein said means for generating a pulse are arranged in a descending region of the toilet bowl and, during flushing, generate a downwardly directed flow cone, and wherein said means comprises at least one of (1) a plurality of pulse nozzles and (2) at least one annular gap.

2. The flushing arrangement according to claim 1, wherein said pulse nozzles and/or said at least one annular gap are arranged in the region of a U-bend water line of the toilet bowl.

3. The flushing arrangement according to claim 1, wherein said pulse nozzles and/or said at least one annular gap are arranged directly above or below a U-bend water line.

4. The flushing arrangement according to claim 1, wherein the pulse nozzles are arranged individually on the toilet bowl.

5. The flushing arrangement according to claim 1, wherein said pulse nozzles and/or said at least one annular gap have at least one channel extending at least partially or completely over the periphery of an inside of the toilet bowl.

6. The flushing arrangement according to claim 1, wherein the annular and downwardly directed flow is generated by water, air or a mixture of water and air.

7. The flushing arrangement according to claim 1, wherein the inside of the descending region of the toilet bowl narrows downwardly and in that the medium flowing out of said means during flushing flows downwardly along said inside to a saddle point arranged in a lower region of the U-bend.

8. The flushing arrangement according to claim 7, wherein during flushing, a wall jet is formed at said saddle point.

9. The flushing arrangement according to claim 8, wherein the wall jet extends substantially horizontally starting from the saddle point.

10. The flushing arrangement according to claim 8, wherein the wall jet forms at least one rotating vortex and/or a core jet.

11. The flushing arrangement according to claim 7, wherein the saddle point is located upstream of a vertex of the U-bend, in the direction of flow.

12. A method of operating a flushing arrangement according to claim 1, wherein a flushing is initiated and in that, as a result of this flushing generated here, an annular and downwardly directed flow is generated in the descending region of the toilet bowl in the water present in the U-bend.

13. The method according to claim 12, wherein the annular and downwardly directed flow is directed towards a saddle point on the inside of the U-bend.

14. The method according to claim 12, wherein a main flushing is additionally initiated, in which water is introduced into the toilet bowl from an upper flushing channel.

* * * * *